United States Patent [19]

Stieger

[11] Patent Number: 5,031,892

[45] Date of Patent: Jul. 16, 1991

[54] APPARATUS FOR REMOVING BLANKS FROM A PILE AND CONVEYING THEM ONWARDS

[75] Inventor: Othmar Stieger, Kindhausen, Switzerland

[73] Assignee: Elpatronic AG, Zug, Switzerland

[21] Appl. No.: 541,716

[22] Filed: Jun. 21, 1990

[30] Foreign Application Priority Data

Jul. 6, 1989 [CH] Switzerland ..... 02513/89

[51] Int. Cl.[5] ..... B65H 5/22

[52] U.S. Cl. ..... 271/10; 271/14; 271/102; 271/107; 271/42; 271/132; 414/797; 901/25; 74/99 R

[58] Field of Search ..... 271/4, 5, 99, 102, 107, 271/42, 131, 132, 267, 10, 11, 14; 414/797; 901/25; 74/44, 99 R; 221/211, 262

[56] References Cited

U.S. PATENT DOCUMENTS

| | | | |
|---|---|---|---|
| 2,596,386 | 5/1952 | Egge | 271/107 X |
| 2,808,766 | 10/1957 | Larsen | 271/102 X |
| 3,005,631 | 10/1961 | McVicker et al. | 271/102 |
| 4,272,998 | 6/1981 | F'Geppert | 74/99 R |
| 4,659,929 | 4/1987 | Fujiwara et al. | 271/107 X |
| 4,703,607 | 11/1987 | Tropper et al. | 221/211 X |
| 4,848,764 | 7/1989 | Tajima et al. | 271/107 X |
| 4,917,663 | 4/1990 | Pazdernik | 271/107 X |

FOREIGN PATENT DOCUMENTS

| | | | |
|---|---|---|---|
| 248832 | 11/1986 | Japan | 271/107 |
| 252840 | 10/1988 | Japan | 271/107 |
| 242331 | 9/1989 | Japan | 271/107 |
| 1263407 | 10/1986 | U.S.S.R. | 414/797 |
| 1319980 | 6/1987 | U.S.S.R. | 419/797 |

*Primary Examiner*—Robert P. Olszewski
*Assistant Examiner*—Boris Milef
*Attorney, Agent, or Firm*—McCormick, Paulding & Huber

[57] ABSTRACT

A stack of blanks is guided between pile guides. Disposed on a support are holding members which can be laid against an exposed blank in the stack in order to grasp it and to be moved, with it, away from the stack. In the course of this, the support is movable over a path which, starting from the stack, extends transversely to the plane of the blanks, then changes over into a direction at least substantially parallel to the plane of the blanks and leading to a pair of conveying members and finally again extends transversely to the plane of the blanks. The conveying members grip the blanks delivered to them by the support, at both sides and convey it onwards.

7 Claims, 2 Drawing Sheets

APPARATUS FOR REMOVING BLANKS FROM A PILE AND CONVEYING THEM ONWARDS

The invention relates to an apparatus for removing blanks, for example blanks for can bodies of sheet metal, from a stack and conveying them onwards, and which has stack guides in which a stack of blanks is guided, at least one holding member which can be laid against an exposed blank in the stack, in order to grip it, a support which carries the holding member and is movable, with the member and the blank attached thereto, away from the stack, and a pair of conveying members which grip the blank delivered to them by the support and convey it onwards.

During the production of can bodies, apparatus of this kind is generally used in order to introduce blanks cut into rectangles into a device for rounding the blanks. This must be done with short cycle times of the order of magnitude of 0.1 to 0.2 seconds for example, and with great accuracy.

An apparatus of the said kind is known from DE 35 26 489 C2 wherein, in each working cycle, the bottom blank of a stack held between vertical stack guides is gripped at its underside by one or more suction cups secured to a support. The support is connected by parallelogram links to a stationary frame in such a manner that it is movable in an arc at first leading vertically downwards away from the stack and gradually changing to a horizontal direction of movement, parallel to itself. On each such movement, a blank is deposited on a pair of parallel guide rails which are arranged horizontally below the pile stack. A sliding carriage, on which pairs of catches are disposed to entrain one blank each, can be moved backwards and forwards along the guide rails.

Another similarly designed apparatus of the kind described at the beginning is known from EP 0 196 494 A1. There a support equipped with suction cups is likewise moved up and down by an eccentric in such a manner that it removes blanks individually from a stack, from below, and deposits them on a table on which the blanks are pushed, by a slide which can be reciprocated horizontally, between pairs of rolls whereby they are conveyed onwards horizontally.

The removal of blanks from a stack can also be effected upwards. Thus a further apparatus of the kind described at the beginning is known from US 3 409 149 wherein, in each working cycle, the uppermost blank of a stack is gripped by a plurality of suction cups which are suspended on rods which extend downwards through between magnetic rolls, from a frame-like support. The support hangs on parallelogram links and is movable upwards in such a manner that the blank gripped by the suction devices is lifted into a position in which it lies against belts which wrap around the magnetic rolls. In this position, the blank is released and is fed horizontally by the belts to a pair of rolls which grip the blank and convey it onwards.

In all these known forms of apparatus, the removal of the blanks from the stack is a first operation, and the transfer of the blanks to a pair of conveying elements which grip the blanks at both sides is a second operation, separate from the first. The present invention is based on the knowledge that this separation is the cause of oscillation of the blanks which occurs in the known apparatus and which can reduce both the frequency and the accuracy of the movements of the blanks from the stack to the conveying members conveying them onwards.

It is therefore the object of the invention to construct an apparatus for removing blanks from a pile and conveying them onwards, particularly sheet metal blanks for can bodies, so that the blanks can be fed rapidly, largely without vibration, and accurately to the conveying members provided for conveying the blanks onwards.

According to the invention, the problem is solved with an apparatus of the kind described at the beginning in that the support is movable over a path which, starting from the stack, extends transversely to the plane of the blanks, then changes over into a direction at least substantially parallel to the plane of the blanks and leading to the pair of conveying members and finally extends transversely to the plane of the blanks again.

Advantageous further developments of the invention can be seen from the sub-claims.

One example of embodiment of the invention is explained with further details below with reference to diagrammatic drawings.

Figure 1:
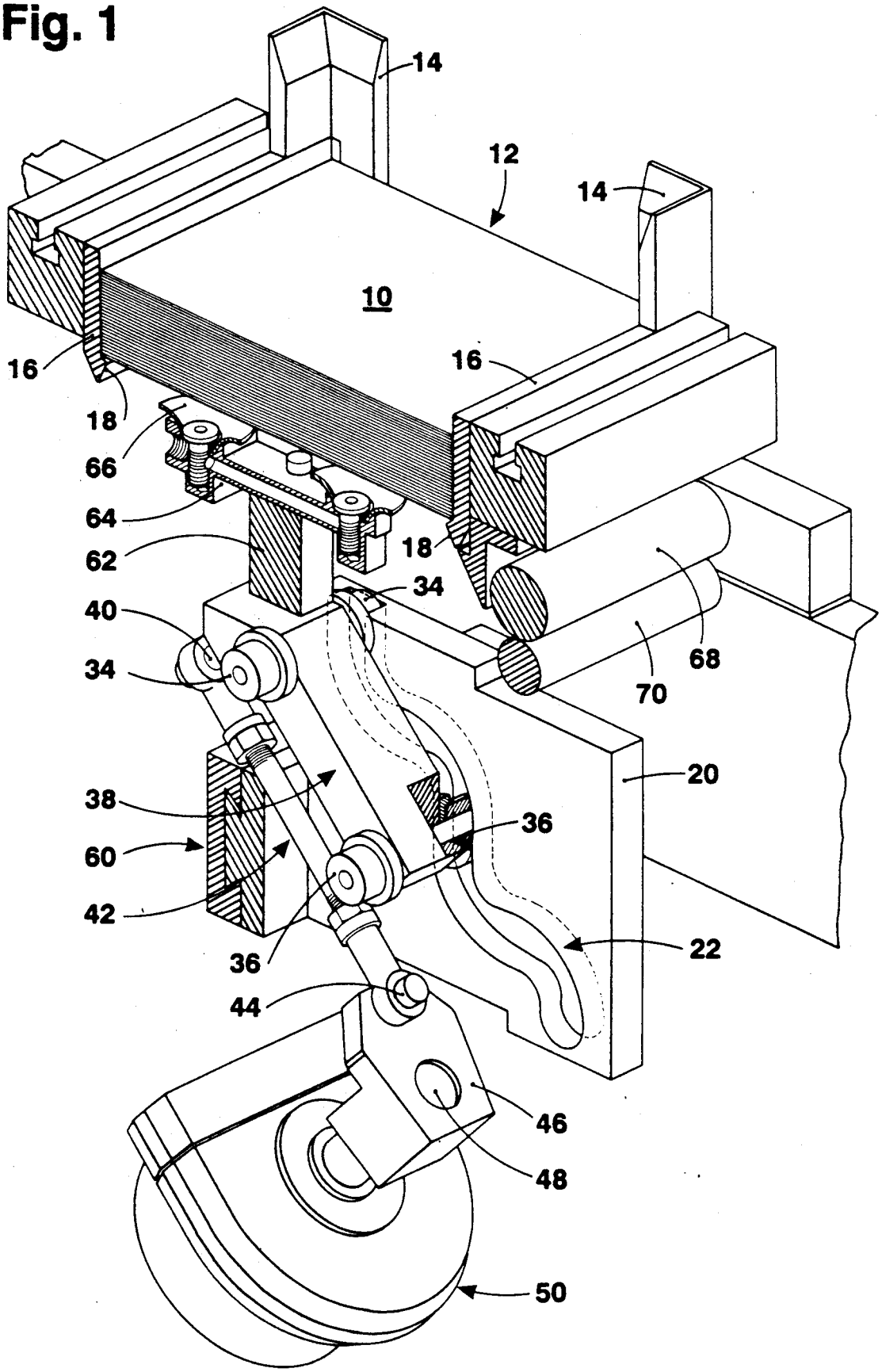
FIG. 1 shows an oblique view of the apparatus, partially in section in a vertical plane.

The apparatus illustrated is provided for removing blanks 10 from a stack and conveying them onwards, the blanks being held ready in the form of the stack 12 between vertical stack guides 14. The stack guides 14 are connected to one another in pairs by marginal strips 16 each of which has an inwardly extending projection 18 on which the bottommost blank 10 of the stack rests.

Disposed at a spacing below the stack 12 are two parallel vertical plates 20, only one of which is illustrated. Machined in each of the facing surfaces of the two plates 20 is a serpentine groove which forms a guide curve 22 and comprises three vertical portions 24, 26 and 28 as well as horizontal portions 30 and 32 situated in between. Each of the said portions 24 to 32 may be as short as desired and, in the extreme case, may be formed only by a turning point between successive arcuate portions, which are preferably quarter-circles.

The guide curves 22 may, for example, be milled in the two plates 20 with an end-milling cutter and have such a width that in each of the two guide curves 22, two cam-follower members 34 and 36 can be moved up and down without jamming but also almost without play. In the example illustrated, the cam-follower members 34 and 36 are rollers which are mounted in pairs on a support 38. The support 38 is connected by a ball-and-socket joint 40 to one end of a connecting rod 42 which is adjustable in length in the manner of a turnbuckle. The other end of the connecting rod 42 is connected, by a further ball-and-socket joint 44, to a crank 46 which is secured to the shaft 48 of a rotary motor 50.

Figure 2:
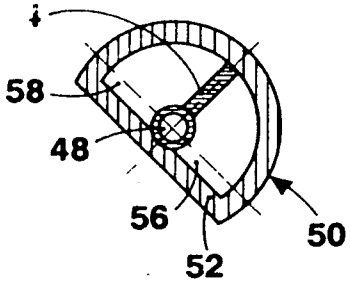
FIG. 2 is a detail sectional view of the rotary motor in FIG. 1.

According to FIG. 2, the rotary motor 50 has a casing 52 in which the shaft 48 is mounted and a rotary vane 54 secured to the latter can be turned backwards and forwards between adjustable stops 56 and 58. The rotary motor 50 is of ordinary commercial construction and can be driven by a fluid under pressure, preferably compressed air, which is fed to it via adjustable throttles to pivot the vane 54. Thus the distance and speed whereby the support 38 can be moved up and down along the guide curves 22 are adjustable.

Secured to the support 38 is a vertical column 62 which carries a yoke 64. Secured to the yoke 64 are a plurality of holding members 66, for example two members, which, in the example illustrated, are formed by suction cups. The members 66 can be laid against the underside of the bottom blank 10. .

Disposed below that pair of stack guides 14 located on the right in the drawings is a pair of conveying members 68 and 70 which, in the example illustrated, are formed by horizontal rolls and are intended to grasp each individual blank 10 at both sides, that is to say above and below, and to supply it to a device whereby it will be rounded in order to be subsequently welded to form a cylindrical can body.

Figure 5:
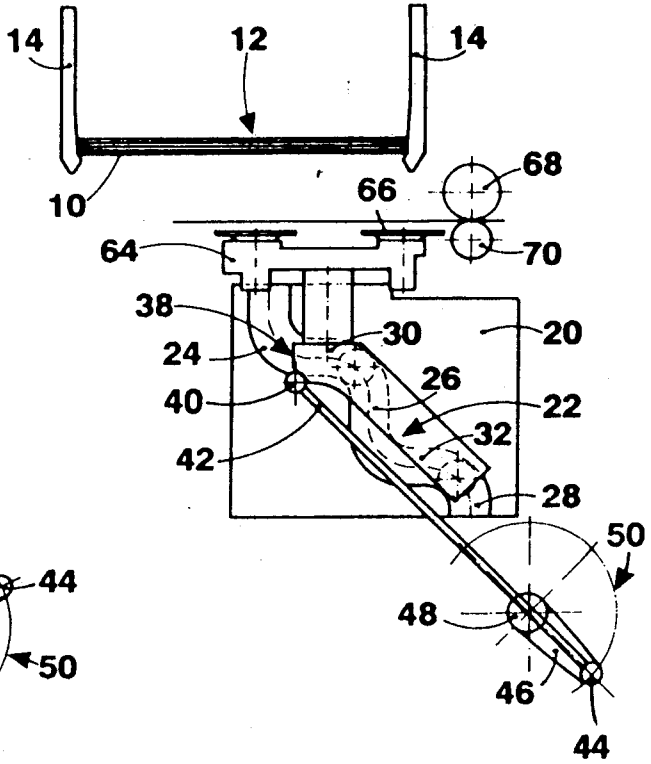
FIGS. 3 to 5 show simplified side views of the apparatus in three successive working positions.
Figure 4:
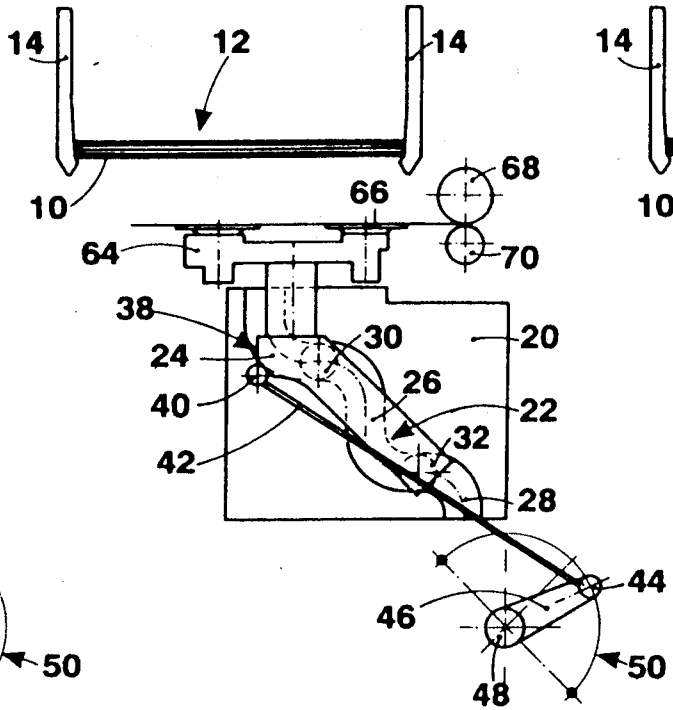
Figure 3:
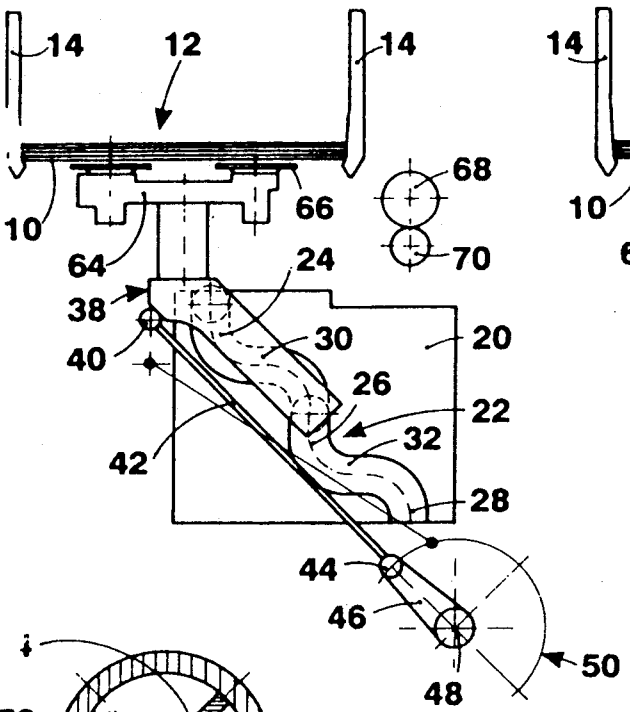

In FIGS. 3 to 5, the plane in which the shaft 48 of the rotary motor 50 lies is shown swung through 90° out of the plane of the drawing for the sake of clarity. In fact, however, as illustrated in FIG. 1, the axis of the shaft 48 is fixed in a position extending at right-angles to a tangential plane which touches the guide curves 22 and which is inclined at 45° in relation to the horizontal plane of the blanks in the example illustrated. The connecting rod 42 stays at least substantially in this tangential plane.

FIG. 3 shows the apparatus at the beginning of a working cycle. In this case, the rotary motor 50 and hence also the support 38 assumes an end position which is determined by the adjustable stop 58. In this end position, the holding members 66 grip the bottom blank 10 in the stack 12.

Then the rotary motor is switched on so that the support 38 is pulled obliquely downwards by the connecting rod 38. In the course of this, the cam follower members 34 and 36 roll in the serpentine guide grooves 22, each simultaneously in precisely the same direction, so that the support 38 is guided without tilting and the blank 10 attached to the holding members 66 by suction remains parallel to its original position, that is to say horizontal in the example illustrated.

After the shaft 48 has turned through about 110° to 120°, the support 38 has reached the position shown in FIG. 4 in which that edge of the blank 10 on the right in FIGS. 3 to 5 has penetrated between the conveying members 68 and 70 and is gripped by these. The holding members 66 now release the blank 10. This can be done by releasing a vacuum previously applied to the holding members 66 or even replacing it by a blast of air. If the holding members 66 are electromagnets, the polarity of these is reversed to release the blank.

During this or following thereon, the rotary motor 50 moves on until its rotary blade 54 strikes against the adjustable stop 56. During this stage, the support 38 reaches its end position represented in FIG. 5. As soon as the blank 10 has been moved on by the conveying members 68 and 70 and has freed the area of movement of the support 38 as a result, the direction of motion of the rotary motor 50 is reversed so that the support 38 returns to its initial position as shown in FIG. 3.

Instead of the rotary motor 50 represented, another driving means may be provided for the support 38, for example a pneumatic piston-and-cylinder unit.

I claim:

1. Apparatus for removing blanks, particularly blanks for can bodies of sheet metal, from a stack and conveying them onwards, having at least one holding member which can be laid against an exposed blank in a stack, in order to grasp it, at least one pair of S-shaped guides, each of which has two portions extending transversely to the plane of the blanks and a portion disposed therebetween and extending substantially parallel to the plane of the blanks, a support which carries the holding member and comprises at least one pair of cam follower members which are each guided in portions of the two guides corresponding to one another, and conveying members which convey onwards the blank delivered to them by the support characterized in that the two guides are combined to form a serpentine guide curve in which a portion extending transversely to the plane of the blanks is common to both guides and is travelled over successively by the two cam follower members.

2. Apparatus according to claim 1, characterized in that the support is arranged between two plates on each of which there is formed a guide curve, two pairs of cam follower members are arranged on the support in such a manner that the support is guided in the same manner on both guide curves.

3. Apparatus according to claim 1 characterized in that articulated on the support is one end of a connecting rod, the other end of which is articulately connected to a crank.

4. Apparatus according to claim 3, characterized in that the crank can be turned back and forth within an adjustable angular range by a rotary motor.

5. Apparatus according to claim 3, characterized in that the length of the connecting rod is adjustable.

6. Apparatus according to claim 5, characterized in that the crank can be turned back and forth within an adjustable angular range by a rotary motor.

7. Apparatus according to claim 4, characterized in that the length of the connecting rod is adjustable.

* * * * *